United States Patent [19]

Hamada et al.

[11] Patent Number: 4,651,058

[45] Date of Patent: Mar. 17, 1987

[54] APPARATUS AND METHOD OF OPERATION FOR AN ELECTRON BEAM SOURCE

[75] Inventors: Kiyoshi Hamada, Sakai; Masanori Watanabe, Katano; Kinzo Nonomura, Hirakata; Minoru Katsuyama, Neyagawa; Riyuma Hirano, Moriguchi, all of Japan

[73] Assignee: Matsushita Electric Industrial Co., Ltd., Kadoma, Japan

[21] Appl. No.: 689,932

[22] Filed: Jan. 9, 1985

[51] Int. Cl.[4] ..... H05B 39/00; H05B 41/14

[52] U.S. Cl. ..... 315/98; 313/422; 315/366; 315/106; 315/107; 328/270

[58] Field of Search ..... 315/105, 106, 107, 94, 315/98, 169.1, 334, 335, 366; 328/270, 263; 313/422

[56] References Cited

U.S. PATENT DOCUMENTS

| | | | |
|---|---|---|---|
| 4,167,690 | 9/1979 | Gange | 313/422 |
| 4,227,117 | 10/1980 | Watanabe et al. | 313/422 |
| 4,451,758 | 5/1984 | Watanabe et al. | 313/495 |

FOREIGN PATENT DOCUMENTS

| | | | |
|---|---|---|---|
| 2127616 | 4/1984 | United Kingdom | 313/422 |

*Primary Examiner*—Saxfield Chatmon

*Attorney, Agent, or Firm*—Cushman, Darby & Cushman

[57] ABSTRACT

Apparatus and method for substantially equalizing the potential drop along a line cathode used in an electron beam source adapted for use in a flat display device. The apparatus and method ensure that electrons from a power source are fed through both ends of the line cathode, substantially simultaneously. Thereby, the potential drop along the axial length of the line cathode is decreased, improving the uniformity of brightness of the display.

17 Claims, 11 Drawing Figures

APPARATUS AND METHOD OF OPERATION FOR AN ELECTRON BEAM SOURCE

BACKGROUND OF THE INVENTION

1. Field of the Invention

The present invention relates generally to an operating system of an electron beam source, and to an operating method of the same. It particularly concerns an operating system and an operating method for an electron beam source suitable for a flat display device.

2. Description of the Prior Art

Hitherto, flat display devices are known which display numerals or characters by selectively extracting electron beams from a selected one of several electron beam sources, each source consisting of one line cathode and at least an extracting electrode. For example, such devices are available from Digitron or Itron (trademarks for vacuum fluorescent displays manufactured by Isedensi Kogyo Kabushiki Kaisha of Japan, respectively). In such known display devices, since the area of the display section is relatively small and since no halftones are required, non-uniformity of the electron beam source has not been a grave problem.

However, in the case of a flat display device having plural line cathodes, a control grid and a phosphor screen are used for displaying the picture image, such as a television picture which has a relatively large size and requires various halftones. Therefore, an electron beam source capable of providing a uniform current density all over the display area is required in order to afford uniformity of brightness all over the display area.

Furthermore, in a display system using deflection of electron beams, and which has wires connected between the electrodes and their driving circuits, in order to improve the resolution of the picture image or in order to simplify the configuration of the device by reducing number of electrodes, uniformity of the energies of the electron beams over the display area of the device is required. Non-uniformity of energy of the electron beam or non-uniformity of electron beam density of the electron beam source are classified into a horizontal non-uniformity and a vertical non-uniformity. The horizontal non-uniformity is a non-uniformity between respective positions along an axial direction of the line cathode, and may be referred to as axial non-uniformity. The latter non-uniformity is a vertical non-uniformity which is a non-uniformity between respective positions in the vertical direction. The axial non-uniformity is mainly caused by potential variations along the axial length of the line known prior art includes.

As a known art proposed by a part of members of U.S. Pat. No. 4,227,117 (certain inventors of which are also inventors of the present invention). FIG. 1 and FIG. 2 of this application show the configuration of the electron beam source in the above-mentioned United States Patent. FIG. 2 shows a cross-section of the invention of a part of the above-mentioned United States Patent. The apparatus has a line cathode 1, a back electrode 2, and an electron-extraction electrode 3. The line cathode 1 is made by coating an electron emitting oxide material on the surface of a tungsten wire of several tens of μm in diameter, and a heating current is passed through the tungsten wire. The back electrode 2 is configured in U-shaped sections which surround each line cathode 1, and is usually configured in a consecutive configuration as shown in FIG. 2. The electron-extraction electrode 3 is isolated from the back electrode 2, and has a series of apertures 4 arranged in front of the line cathode 1 so as to extract electrons and emit them through the apertures to make electron beams. The equipotential lines 8 are shown in FIG. 2.

The conventional electron beam source with the line cathode is configured as shown in FIG. 3, wherein the components designated by numerals 1, 2, 3 and 4 are those described with respect to FIG. 1 and FIG. 2. In actual use in a flat type cathode ray tube, an acceleration electrode 5 having a series of apertures 51 (or a slit in place thereof) is disposed in parallel with the electron-extraction electrode 3 with a predetermined gap inbetween and in insulated relation therewith. One end of the line cathode 1 is connected through a resistor R to a positive end of a power source V1. The other end of the line cathode 1 is connected to an anode of a diode 6, and a cathode of the diode 6 is connected to a negative end of the power source V1. A negative pulse generator 7 is connected by its output terminal 71 to the above-mentioned one end of the line cathode 1, and by its other end to the common connected ground point G, i.e. the cathode of the diode 6. To the back electrode 2, a negative end of a second power source V2 is connected and the other end of the second power source V2 is connected to the common connected ground point G. To the electron-extraction electrode 3, a positive end of a third power source V3 is connected and a negative end of the third power source V3 is connected to the common connected ground point G. To the acceleration electrode 5, a positive end of a fourth power source V4 is connected and a negative end of the fourth power source V4 is connected to the common connected ground point G.

The above-mentioned conventional system operates as follows. When the output of the negative pulse generator 7 is zero volts, the line cathode 1 is heated by a current fed from the first power source V1 and the electron-extraction electrode 3 is impressed with positive potential from the power source V3. Therefore, no electron beams are emitted through the apertures 4 and 51 since the back electrode 2 (which surrounds three sides of the line cathode 1) is impressed with a negative potential by the second power source V2. That is, the back electrode 2 functions to prevent emission of electrons from the line cathode 1 upon the application of the negative potential. In such a state, when a negative pulse potential is applied from the negative pulse generator 7 to one end of the line cathode 1, the potential of the line cathode 1 becomes negative in relation to the back electrode 2, and therefore, the line cathode 1 emits electrons. At that time, the diode 6 becomes reversely biased by the output potential of the negative pulse generator 7, and therefore turns OFF because of the negative bias, hence stopping the flow of the heating current from the first power source V1 to the line cathode 1. Therefore, in this system no potential gradation is generated along the line cathode 1 by means of the heating current.

However, the system of the above-mentioned circuit connection has the shortcoming that the different positions along the line cathode have different potentials due to potential falls caused by the current of the electron emission itself. This phenomenon is described with reference to FIG. 4.

The same number of electrons as are emitted from various points of the surface of the line cathode 1 are fed from the negative pulse generator 7 and flow through the line cathode itself which has its own resistance. Accordingly, the current induced by the electron emission from the line cathode 1 flows in an opposite direction as the flow of the emission electrons, flowing from right to the left in FIG. 4. Accordingly a voltage drop is induced along the line cathode 1. That is, the potentials on various points of the line cathode 1 are not the same. Such differences in potentials along the line cathode 1 cause differences in the currents of the electron beams themselves depending on positions along the line cathode 1. Such differences produce non-uniformity of brightness of the image produced.

SUMMARY OF THE INVENTION

The purpose of the present invention is to provide an improved operating system and operating method of an electron beam source wherein the potential drop along the the line cathode due to electron emission is considerably decreased, thus providing a more uniform electron beam current along axial positions of the line cathode.

The above-mentioned object is realized by making the potentials at both ends of the line cathode substantially equal during the period of electron emission. The above-mentioned equalization of potential at both ends of the line cathode is carried out by feeding the current for electron emission from both ends of the line cathode thereby decreasing the potential drop along the line cathode during the electron emission.

An operating system of an electron beam source for a display device in accordance with the present invention comprises:

- a line cathode,
- a back electrode,
- an electron-extraction electrode having apertures for emission of electrons therethrough and disposed in front of the line cathode,
- a power source for feeding electrons to the line cathode for electron emission, and
- connection circuit for feeding the electrons from the power source to the line cathode through both ends thereof.

Furthermore, a method of operating an electron beam source for a display device in accordance with the present invention having a line cathode, a back electrode and an electron-extraction electrode having apertures for emission of electrons and disposed in front of the line cathode, comprises the steps of:

- changing the potential of the line cathode alternately to a first potential which is relatively lower than potentials of the back electrode and the electron-extraction electrode to enable electron emission, and to a second potential which is relatively higher than potentials of the back electrode and the electron-extraction electrode to disable electron emission, and
- feeding electrons to the line cathode through both ends of the line cathode.

DETAILED DESCRIPTION OF THE PREFERRED EMBODIMENT

Figure 5:
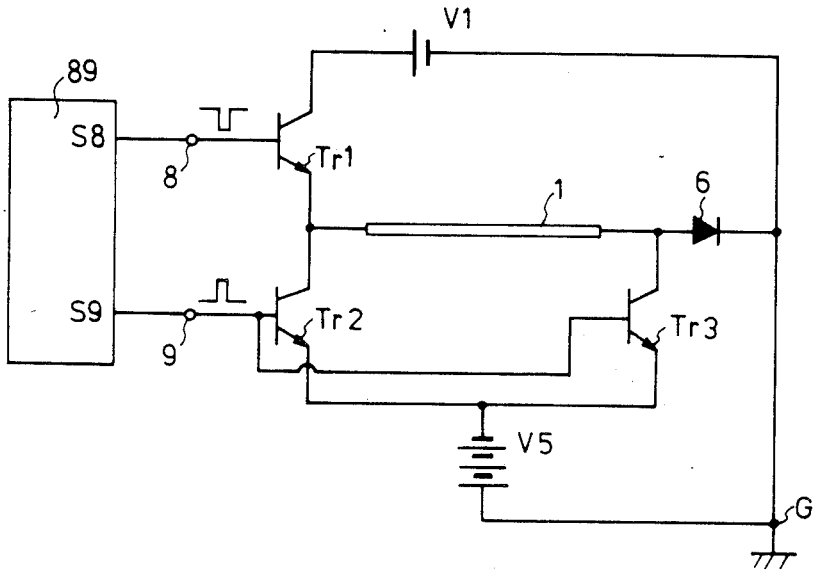
FIG. 5 is a circuit diagram showing one example of the present invention.
Figure 6:
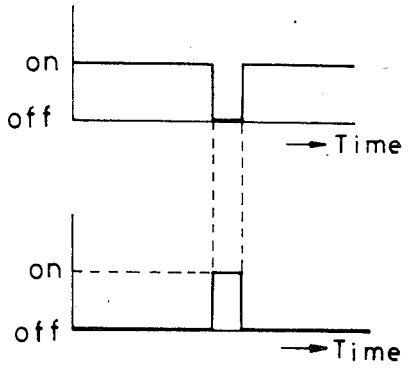
FIG. 6 is a timing chart showing operation of the circuit of FIG. 5.

FIG. 5 shows a preferred embodiment of an electron beam source system in accordance with the present invention. Both ends of a line cathode 1 are connected to the collectors of a transistor TR2 and another transistor TR3, respectively, and the emitters of the transistors TR2 and TR3 are commonly connected to a negative end of a cathode potential source V5. Both the bases of the transistor TR2 and Tr3 are connected to an input terminal 9. A junction point between one end of the line cathode 1 and a positive end of the cathode potential source V5 is connected to a ground point G. An emitter-collector circuit of a switching transistor Tr1, a cathode heating power source V1 and the diode 6 are connected in series across both ends of the line cathode 1. The base of the switching transistor Tr1 is connected to another input of terminal 8. A negative potential source V5 is for impressing a negative potential to the line cathode 1 for actuation thereof to emit electrons. The terminals 8 and 9 are connected to output terminals S8 and S9 of a driving circuit 89 such as a flip-flop circuit which generates pulse signals of opposite polarities as shown in FIG. 6. Known other electrodes, such as an electron extraction electrode 3 and an acceleration electrode 5 and voltage sources therefor are omitted in FIG. 5 and drawings of subsequent embodiments for simplicity.

The operation of the embodiment of FIG. 5 is as follows. Since the transistor Tr1 and the transistors Tr2 and Tr3 receive opposite polarity input signals from the terminals 8 and 9, respectively, the transistor Tr1 and the transistors Tr2 and Tr3 turn on and turn off, respectively, in an alternating manner. During the ON-period of the transistor Tr1, the line cathode 1 is heated by a current flowing from the power source V1, through the transistor Tr1, the line cathode 1, the diode 6 and to the power source V1. On the contrary, when the transistors Tr2 and Tr3 are ON, the cathode heating current is stopped for a short period and a negative potential of the cathode potential power source V5 is applied through the transistors Tr2 and Tr3. Though the heating current from the power source V1 is stopped for this short period, the line cathode 1 can emit electrons for this short period since the high temperature of the line cathode is maintained for the short period. In this circuit connection, since the negative potential of the cathode potential power source V5 is applied at the same time at both ends of the line cathode 1, the electrons to be emitted from the line cathode 1 are fed through both ends of the line cathode, and therefore the potential drop along the line cathode 1 is much decreased.

Figure 7:
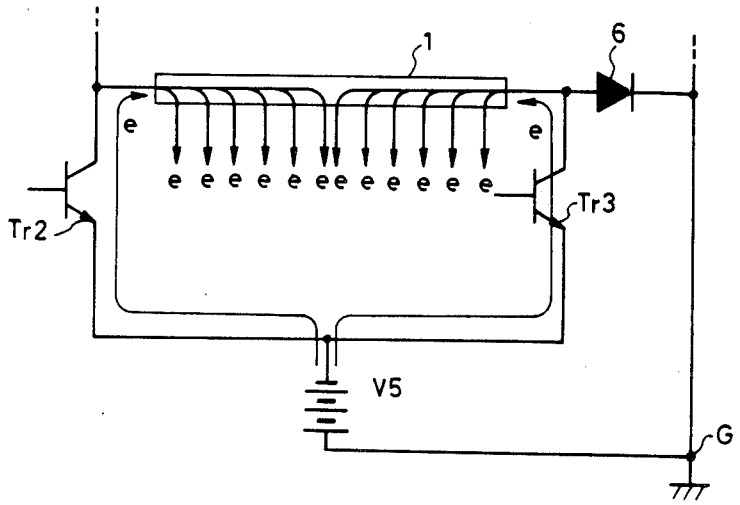
FIG. 7 is a circuit diagram of an essential part of the circuit of FIG. 5, illustrating the flow of current of the electron emission of FIG. 5.

FIG. 7 illustrates the flow of electrons emitted from the line cathode 1. As shown in FIG. 7, the electrons "e" flow from the negative end of the cathode potential power source V5 through both transistors TR2 and TR3, and both ends of the line cathode 1, to continuous surfaces of the line cathode 1. Since, the electrons flow from both ends to the center as a gradually decreasing current, (as a result of electron emissions along the cathode surface), the potential drop along the axial length of the line cathode 1 is in symmetry with respect to the center of the line cathode 1. Therefore, the absolute value of the maximum potential drop in the line cathode is far smaller than the conventional ones.

Figure 1:
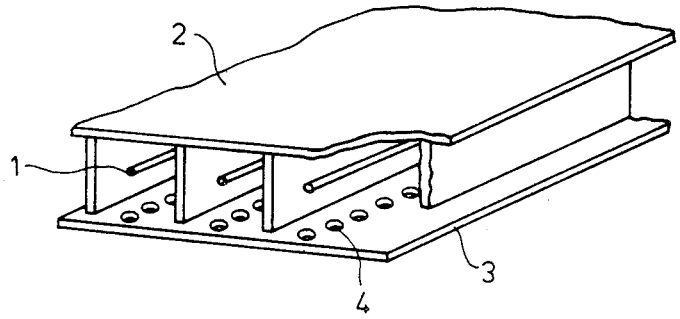
FIG.1 (Prior Art)
FIG. 1 is a perspective view showing the conventional electron beam source having a line cathode.
Figure 2:
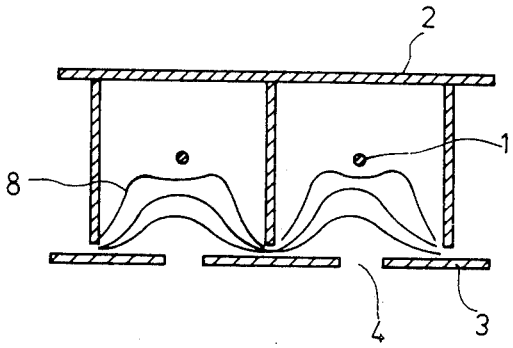
FIG.2 (Prior Art)
FIG. 2 is a sectional view of FIG. 1 showing equipotential lines of the electron beam source.
Figure 3:
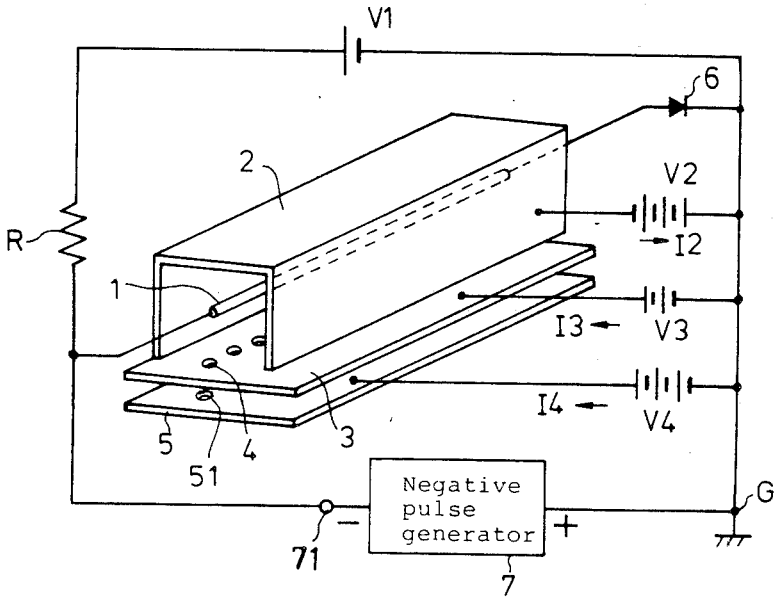
FIG. 3 (Prior Art)
FIG. 3 is a circuit diagram of a known device showing applications of voltages from the power sources and the negative pulse generator for operating the system of the electron beam source.
Figure 4:
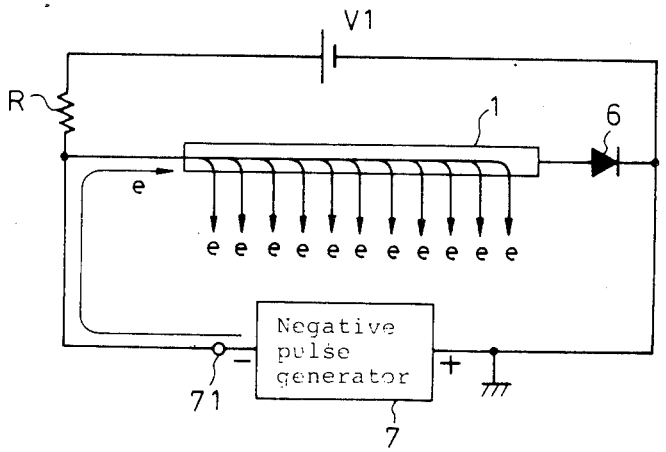
FIG. 4 (Prior Art)
FIG. 4 is an equivalent circuit diagram illustrating the flow of the electron beams in the operating system of FIG. 3.
Figure 8:
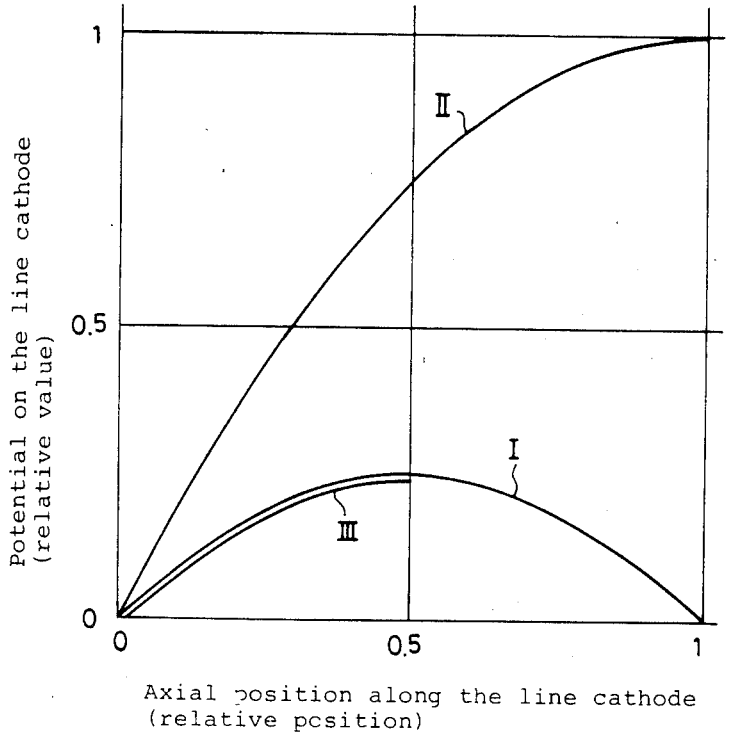
FIG. 8 is a comparison graph showing potential distribution along the axial position of the line cathode for the embodiments of the present invention, and a comparison sample of a conventional system.

FIG. 8 comparatively shows potentials along the axial position of the line cathode, wherein a curve I shows the case of the embodiment of the present invention, curve II shows the potential drop of the prior art example (such as of FIG. 4) of the same length of the line cathode as the above-mentioned embodiment, and the curve III shows a comparison case where the length of the line cathode is selected to be half of the above embodiment, and the circuit is configured in the conventional manner shown in FIG. 4.

Figure 9:
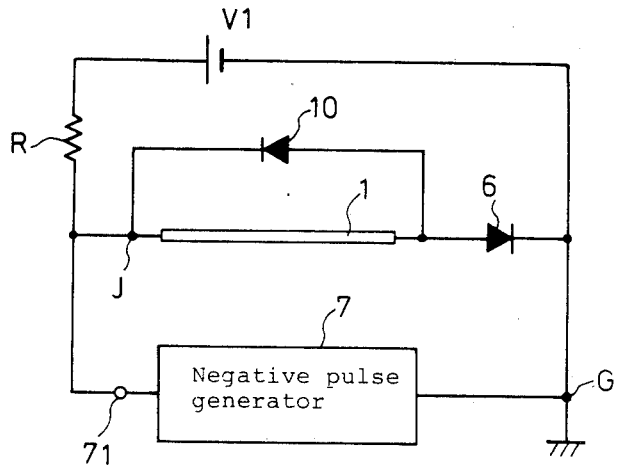
FIG. 9 is a circuit diagram showing another embodiment of the present invention.

FIG. 9 shows a circuit connection of another embodiment of the present invention. In this embodiment, across both ends of the line cathode 1, a diode 10 is connected. The cathode of diode 10 is connected to one end of the line cathode 1 and connected through a resistor R to a positive end of the heating power source V1. The anode of the diode 10 is connected to the other end of the line cathode 1 and connected to the anode of a diode 6, and the cathode of the diode 6 is connected to a negative end of the heating power source V1. An output terminal 71 of a negative pulse generator 7 is connected to the above-mentioned one end of the cathode, i.e., the junction point J of the resistor R, the cathode of the diode 10 and the line cathode 1, to feed negative pulses to the junction point. The other end of the negative pulse generator 7 is connected to the cathode of the diode 6.

Operation of this embodiment is as follows. Heating of the line cathode 1 is carried out by a heating current flowing in a loop from the heating power source V1, through resistor R, line cathode 1, diode 6 and to the negative end of the heating power source V1. During this heating of the line cathode 1, the voltage drop across the line diode 1 induces an inverse voltage to the diode 10, and therefore the diode 10 is in a cut-off state. Then, when a negative pulse is impressed on the junction point J from the negative pulse generator 7, the potential of the line cathode 1 is lowered, and the line cathode is actuated to emit electrons. When a voltage drop due to flow of electrons in the line cathode is liable to generate a voltage drop across the line cathode 1 in such a manner that the potential of the right end of the line cathode 1 is higher than that of the left end, the voltage difference is short-circuited by the diode 10 which is in the forward direction for such a voltage difference. In other words, the electrons are fed from the output terminal 71 of the negative pulse generator 7 to the left end of the line cathode 1, and at the same time through the diode 10 to the right end of the line cathode 1. Accordingly, by feeding electrons from both ends of the line cathode 1, the potential drop along the axial length of the line cathode 1 is much decreased. Though a small voltage of about 0.7 V is retained across both ends of the line cathode, such a small potential difference can be neglected.

Figure 10:
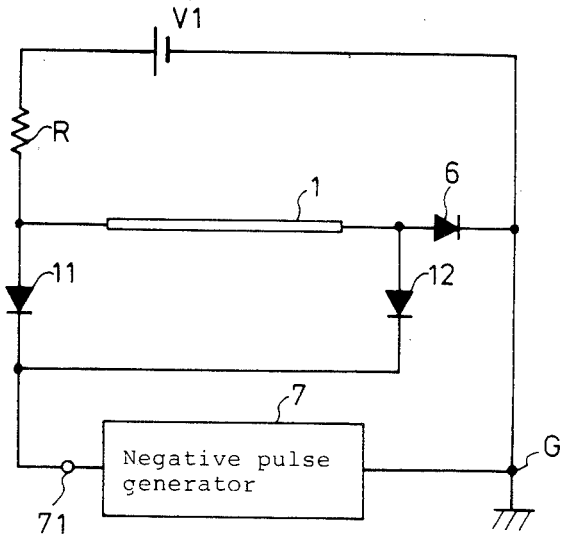
FIG. 10 is a circuit diagram of still another embodiment of the present invention.

FIG. 10 shows a circuit diagram of still another embodiment of the present invention. In this embodiment, the difference from that of FIG. 9 is that, instead of the diode 10 of FIG. 9 two diodes 11 and 12 are connected between the output terminal 71 of the negative pulse generator 7 and left end and right end of the line cathode 1. Other connections are similar to the embodiment of FIG. 9. That is, the left end of the line cathode 1 is connected through a resistor R to a positive end of the heating power source V1 and the right end of the line cathode 1 is connected through a diode 6 to a negative end of the heating power source V1.

The operation of the embodiment of FIG. 10 is as follows. When the output of the negative pulse generator 7 is not at its negative potential, a heating current flows from the positive end of the heating power source V1, through the resistor R, the line cathode 1, the diode 6 and to the negative end of the heating power source V1, thereby heating the cathode. When the negative pulse generator 7 issues the negative pulse, the diodes 11 and 12 are in the ON state. Therefore, potentials at both ends of the line cathode 1 are lowered to the potential of the negative pulse potential plus 0.7 V (which is the ON voltage of the diodes 11 and 12), thereby actuating the line cathode 1 to emit electrons. In this embodiment, the electrons to be emitted from the cathode are fed from the output terminal 71 of the negative pulse generator 7 through the diodes 11 to the 12, and left and right ends of the line cathode 1.

Figure 11:
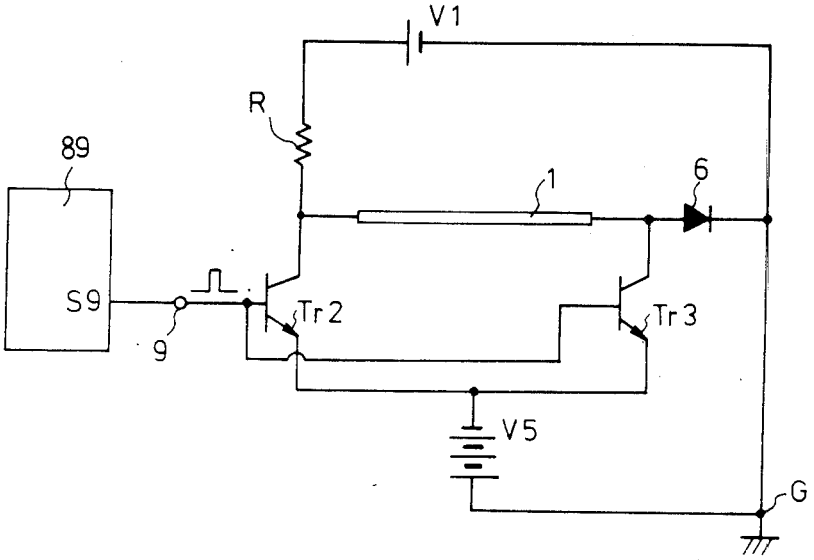
FIG. 11 is a circuit diagram of still another embodiment of the present invention.

FIG. 11 shows still another embodiment, which is a modification of the embodiment of FIG. 5, wherein the switching transistor Tr1 is replaced by a current limiting resistor R. Though the power consumption performance is slightly lower than the embodiment of FIG. 5 because of power consumption in the resistor R, the circuit is much simplified and costs are accordingly reduced. Other parts of the circuit are analogous to the embodiment of FIG. 5.

The switching transistors Tr2 and Tr3 may be replaced by other kind of known switching devices, so long as they can switch pulse signals.

What is claimed is:

1. Electron beam source apparatus, comprising:
a line cathode having first and second ends,
a back electrode,
an electron-extraction electrode having apertures for emission of electrons therethrough and disposed in front of said line cathode,
a power source for feeding electrons to said line cathode for electron emission, and
switching means for feeding said electrons from said power source to said line cathode through both ends thereof, substantially simultaneously.

2. Electron beam source apparatus in accordance with claim 1, wherein said switching means includes means for temporarily impressing substantially the same negative potential on both ends of said line cathode.

3. Electron beam source appparatus in accordance with claim 1 or claim 2, wherein said switching means includes switching devices for simultaneously feeding said electrons to said both ends.

4. Electron beam source apparatus in accordance with claim 1 or claim 2, wherein said switching means includes first and second diodes connected to respective ends of said line cathode for temporarily impressing negative pulse potentials thereto.

5. Electron beam source apparatus in accordance with claim 1, wherein said switching means includes means for temporarily short-circuiting two ends of said line cathode.

6. Electron beam source apparatus in accordance with claim 1 or claim 5, wherein said switching means includes a diode connected across both ends of said line cathode.

7. A method of operating an electron beam source having a line cathode, a back electrode and an electron-extraction electrode having apertures therein for emission of electrons therethrough and disposed in front of said line cathode, comprises the steps of:

changing a potential of said line cathode alternately to a first potential which is relatively lower than potentials of both said back electrode and said electron-extraction electrode to stimulate electron emission from said line cathode, and to a second potential which is relatively higher than the potentials of both said back electrode and said electron-extraction electrode to disable electron emission from said line cathode, and feeding electrons to said line cathode through both ends of said line cathode, substantially simultaneously.

8. A method of operating an electron beam source in accordance with claim 7, wherein said step of changing potential of said line cathode includes the step of temporarily impressing substantially the same negative potential at both ends of said line cathode.

9. A method of operating an electron beam source in accordance with claim 7 or claim 8, wherein said step of changing potential of said line cathode includes the step of switching first and second switching devices connected at both ends of said line cathode.

10. A method of operating an electron beam source in accordance with claim 7 or claim 8, wherein said step of changing potential of said line cathode includes the step of impressing said second potential on said line cathode through diodes connected to respective ends of said line cathode.

11. A method of operating an electron beam source in accordance with claim 7, wherein said step of changing potential of said line cathode includes the step of temporarily short-circuiting two ends of said line cathode.

12. A method of operating an electron beam source in accordance with claim 7 or claim 11, wherein said step of changing potential of said line cathode includes the step of impressing said second potential on said line cathode through a diode connected across both ends of said line cathode.

13. Electron beam apparatus, comprising:

line cathode means, having first and second ends, for emitting electron beams;

means for providing an electrical current to said line cathode means to stimulate the emission of said electron beams; and means for supplying said electrical current to both ends of said line cathode means substantially simultaneously.

14. Apparatus according to claim 13 wherein said supplying means includes first and second transistors coupled to said first and second ends of said line cathode means, respectively.

15. Apparatus according to claim 13 wherein said supplying means includes a diode coupled in parallel with said line cathode means.

16. Apparatus according to claim 13 wherein said supplying means includes a first diode having an anode coupled to said line cathode means first end, a second diode having an anode coupled to said line cathode means second end, and wherein said first and second diodes have cathodes coupled together.

17. Apparatus according to claim 13 wherein said supplying means supplies substantially the same potential of electrical current to said both ends.

* * * * *